US005153091A

United States Patent [19]

Veregin et al.

[11] Patent Number: 5,153,091

[45] Date of Patent: Oct. 6, 1992

[54] MAGNETIC IMAGE CHARACTER RECOGNITION TONER AND PROCESSES THEREOF

[75] Inventors: Richard P. Veregin, Mississauga; Jonathan D. Nash, Berlington; Barkev Keoshkerian, Thornhill, all of Canada

[73] Assignee: Xerox Corporation, Stamford, Conn.

[21] Appl. No.: 632,904

[22] Filed: Dec. 24, 1990

[51] Int. Cl.[5] ..... G03G 13/16

[52] U.S. Cl. ..... 430/126; 430/53; 430/106.6; 430/111; 430/109; 430/138; 346/159

[58] Field of Search ..... 430/111, 109, 126, 138, 430/53, 106.6; 346/159

[56] References Cited

U.S. PATENT DOCUMENTS

| | | | |
|---|---|---|---|
| Re. 33,172 | 2/1990 | Gruber et al. | 430/126 |
| 4,268,598 | 5/1981 | Leseman et al. | 430/107 |
| 4,409,312 | 10/1983 | Ikeda et al. | 430/110 |
| 4,517,268 | 5/1985 | Gruber et al. | 430/39 |
| 4,535,049 | 8/1985 | Honda et al. | 430/137 |
| 4,536,462 | 8/1985 | Mehl | 430/106 |
| 4,555,466 | 11/1985 | Okada et al. | 430/106.6 |
| 4,569,896 | 2/1986 | Perez et al. | 430/106.6 |
| 4,748,506 | 5/1988 | Hieda | 358/213.18 |
| 4,758,506 | 7/1988 | Lok et al. | 430/111 |
| 4,888,264 | 12/1989 | Matsumoto et al. | 430/138 |
| 5,013,630 | 5/1991 | Ong et al. | 430/138 |
| 5,023,159 | 6/1991 | Ong et al. | 430/138 |
| 5,034,298 | 7/1991 | Berkes et al. | 430/111 |

*Primary Examiner*—Marion E. McCamish
*Assistant Examiner*—C. D. RoDee
*Attorney, Agent, or Firm*—E. O. Palazzo

[57] ABSTRACT

An ionographic process which comprises the generation of an image comprised of characters, and developing the image with a toner mixture comprised of an encapsulated toner and a toner free of encapsulation.

3 Claims, No Drawings

MAGNETIC IMAGE CHARACTER RECOGNITION TONER AND PROCESSES THEREOF

BACKGROUND OF THE INVENTION

The present invention is generally directed to toners, and imaging processes thereof, and more specifically the present invention is directed to imaging and printing processes with a mixture of encapsulated toner compositions and toners free of encapsulation including those comprised of resin, pigment, optional additives, and wherein the toners free of encapsulation can be obtained by known melt blending processes, and wherein the mixture of toners are particularly useful for generating documents such as personal checks which are subsequently processed in reader/sorters. In one embodiment of the present invention there are provided processes for generating documents, such as checks, including for example divided checks, turn around documents such as invoice statements like those submitted to customers by American Express and VISA, corporate checks, highway tickets, rebate checks, other documents with magnetic codes thereon, and the like, with no or minimal toner smearing and excellent fixing characteristics. More specifically, in one embodiment the process of the present invention is accomplished with a mixture of an encapsulated toner and a toner free of encapsulation, and wherein image smearing and offsetting of the toner mixture to read and write heads, including offsetting to the protective foil that may be present on the aforesaid heads in magnetic ink character recognition processes and apparatus inclusive of, for example, the read and write heads present in MICR (magnetic ink character recognition) reader/sorters, such as the commercially available IBM 3890 TM, NCR 6780 TM, reader/sorters from Burroughs Corporation, and the like is substantially avoided or minimized. Some of the reader/sorter printers contain protective foils thereon, reference for example the IBM 3890 TM, and the problems associated with such protective foils as illustrated herein with respect to read and write heads with no foils are alleviated with the toner mixture and processes of the present invention. Accordingly, with the processes utilizing the toner mixture compositions the problems of image smearing to, and offsetting from the read and write heads in magnetic ink character recognition apparatuses is substantially eliminated. Moreover, in another embodiment the present invention is directed to improved economical processes for generating documents such as personal checks suitable for magnetic image character recognition wherein image smearing and toner offsetting, including offsetting to read and/or write heads including those with protective foils thereon or unprotected heads as indicated herein, can be avoided when such documents are processed in the aforementioned reader/sorters. The toner compositions of the present invention are also useful in the Xerox Corporation 9700/8700 wherein image smearing and image fixing can be improved.

Toner offset is eliminated or minimized with the processes of the present invention, it is believed, primarily because of the presence of the mixture of encapsulated and nonencapsulated toners. Offset results from, for example, the developed toner image being removed from the MICR (magnetic ink character recognition) document, such as a check, to the read and/or write heads contained in MICR readers such as the IBM 3890 TM and the NCR 6780 TM. When the aforesaid offset is eliminated or substantially reduced, the problem of image smearing onto the MICR documents, such as personal checks, is also avoided. By offset as used herein is meant an embodiment of the present invention that the toner, or toner mixture is released from the document, such as personal checks, and transfers and sticks to the aforementioned read and/or write heads. As a result, toner is removed from the checks, or other documents as illustrated herein primarily in a continuous manner causing image smearing, and substantially preventing the characters on the checks from being read magnetically and thus rejected in most instances. With the processes of the present invention, in embodiments image offset to protective foils as are contained in some reader/sorters, for example the IBM 3890 TM, may be reduced by a factor of 10, or eliminated. Also, with toner buildup on the read/write heads, after passing 1 to 500 checks, or more through the reader/sorter, the excess toner is released to the check document being processed causing image smearing, which is avoided or minimized with the processes of the present invention.

With further respect to the present invention, the process is particularly applicable to the generation of documents including personal checks, which have been fused with pressure roll fusers. Pressure fixing, such as that incorporated into the Xerox Corporation 4060 TM machine, and Delphax S6000 TM ionographic printer, are particularly useful with the processes of the present invention. In addition, fusing systems where heat is used, particularly in combination with pressure, for example where the above mentioned printers have been modified, by heating the pressure roll, or by the addition of a subsequent heat fusing system comprised of two rolls, are also applicable. Examples of specific fusing systems that may be added, for example, are those incorporated in the Xerox Corporation 1090 TM or the Xerox Corporation 5090 TM copiers, suitably modified if necessary to provide a fusing temperature in the range required for the encapsulated toner. Fuser roll temperatures of about 100° C. to about 165° C. are suitable in embodiments of the present invention.

The documents, including the personal checks mentioned herein, can be obtained, for example, by generating a latent image thereon and subsequently developing the image, reference U.S. Pat. No. 4,517,268, the disclosure of which is totally incorporated herein by reference, with the toner mixture illustrated herein. The developed image that has been created, for example, in the Xerox Corporation 4060 TM printer, contains thereon, for example, the characters zero, 1, 2, 3, 4, 5, 6, 7, 8, and 9, and up to four symbols (E-13B and CMC-7 font), which characters are magnetically readable by the IBM 3890 TM, or other similar apparatus. One of the problems avoided with the processes of the present invention is to eliminate or reduce the offsetting of the toner as indicated herein to the read and write heads in the apparatus selected for this purpose, such as the IBM 3890 TM. The imaging methods of the present invention are utilized in systems wherein pressure fusing is selected, reference the Delphax S6000 TM and Xerox 4060 TM.

In one embodiment, the present invention is directed to MICR processes wherein there is selected a toner mixture comprised of an encapsulated toner composition comprised of a core comprised of a polymer including a silane modified polymer resin, magnetite and a polymeric shell thereover preferably prepared by interfacial polymerization; and a toner comprised of resin, wax, such as a solid wax with a melting point of from about 80° C. to about 180° C., magnetite, and optional additives, which toner is free of encapsulation. Another specific embodiment of the present invention relates to MICR processes with a mixture of toners as illustrated herein, and wherein the encapsulated toner compositions are comprised of a core comprised of a silane-modified polymer resin and magnetite particles, which core is encapsulated by a polymeric coating such as a polyurea, polyurethane, polyamide, polyester, or mixtures thereof.

In a patentability search report the following U.S. Patents were listed: U.S. Pat. No. 4,535,049 relating to a single magnetic toner with a combination of a binder resin and wax, see for example column 3, lines 6 to 29; U.S. Pat. Nos. 4,409,312 and 4,569,896 which disclose the combination of wax with a binder resin in a magnetic toner; 4,517,628 relating to MICR process and toners, and mentioned herein; and 4,555,466 relating to a toner which combines a wax with a binder. The disclosures of each of these patents are totally incorporated herein by reference.

There are mentioned as prior art the following U.S. Pat. Nos. 4,770,968 directed to polysiloxane butadiene terpolymer toner resins, reference for example column 4, and note the formulas of FIGS. 1 to 6, including FIG. 2B, which toners can be selected wherein silicone release oils are avoided, with no apparent teaching in this patent directed to encapsulated toners; 4,814,253 directed to encapsulated toners comprised of domains containing a polymer component having dispersed therein a release composition and thereover a host resin component comprised of toner resin particles and pigment particles, see for example the Abstract of the Disclosure and column 4, and note column 4 wherein there is illustrated as one of the components of the encapsulated toner domains comprised of styrene butadiene block polymers such as Kraton, styrene copolymers, or styrene siloxanes, which components have entrapped or dissolved therein mineral oils or silicon oils; and as background interest U.S. Pat. No. 4,430,408 relating to developer compositions containing a fluorene modified alkyl siloxane and a surface treatment carbon black, reference the Abstract of the Disclosure for example; U.S. Pat. No. 4,758,491 relating to dry toner and developer compositions with a multiphase polyorgano siloxane block or graft condensation copolymer, which provides polyorgano siloxane domains of a particular size and concentration at the toner particle surfaces; U.S. Pat. No. 4,820,604 directed to toner compositions comprised of resin particles, pigment particles, and a sulfur containing organo polysiloxane wax such as those of the formulas illustrated in the Abstract of the Disclosure; U.S. Pat. No. 4,307,169 discloses microcapsular electrostatic marking particles containing a pressure fixable core, and an encapsulating substance comprised of a pressure rupturable shell, which shell is formed by an interfacial polymerization; and Japanese Patent Publication 60-073630 relating to MICR toners and processes. One shell prepared in accordance with the teachings of the '169 patent is a polyamide obtained by interfacial polymerization. In the '169 patent, it is indicated that when magnetite or carbon black is selected they must be treated in a separate process to prevent migration thereof to the oil phase.

Interfacial polymerization processes are known and described in British Patent Publication 1,371,179, the disclosure of which is totally incorporated herein by reference, which publication illustrates a method of microencapsulation based on in situ interfacial condensation polymerization. More specifically, this publication discloses a process which permits the encapsulation of organic pesticides by the hydrolysis of polymethylene polyphenylisocyanate, or toluene diisocyanate monomers. Also, the wall forming reaction disclosed in the aforementioned publication is initiated by heating the mixture to an elevated temperature at which point the isocyanate monomers are hydrolyzed at the interface to form amines, which in turn react with unhydrolyzed isocyanate monomers to enable the formation of a polyurea microcapsule wall.

Moreover, there are disclosed in U.S. Pat. No. 4,407,922, the disclosure of which is totally incorporated herein by reference, interfacial polymerization processes for pressure sensitive toner compositions comprised of a blend of two immiscible polymers selected from the group consisting of certain polymers as a hard component, and polyoctadecylvinylether-co-maleic anhydride as a soft component.

Also of interest are U.S. Pat. Nos. 4,517,268, mentioned herein, relating to xerographic toners for MICR printing; 4,268,598 which discloses a nonencapsulated magnetic toner for the printing of machine readable legends; 4,748,506 relating to magnetic encapsulated toners, see column 4, wherein there is mentioned, for example, Columbian Mapico Black, and Bayferrox magnetites; and 3,627,682; 4,439,510; 4,536,462 and 4,581,312, which patents disclose, for example, encapsulated toners with magnetites. The disclosures of each of the aforementioned patents are totally incorporated herein by reference.

Disclosed in U.S. Pat. No. 5,045,422 entitled Encapsulated Toner Compositions, the disclosure of which is totally incorporated herein by reference, are encapsulated compositions containing cores comprised of a fluorocarbon and a monomer or monomers. More specifically, there is illustrated in the aforementioned patent an encapsulated toner composition comprised of a core with a fluorocarbon-incorporated resin binder, pigment or dyes, and a polymeric shell; and an encapsulated toner composition comprised of a core comprised of a fluorocarbon-incorporated resin binder derived from the copolymerization of an addition-type monomer and a functionalized fluorocarbon compound represented by Formula (I), wherein A is a structural moiety containing an addition-polymerization functional group; B is a fluorine atom or a structural moiety containing an addition-polymerization functional group; and x is the number of difluoromethylene functions, pigment or dyes, and a polymeric shell. Also, illustrated in U.S. Pat. No. 5,013,630 entitled Encapsulated Toner Compositions, the disclosure of which is totally incorporated herein by reference, is an encapsulated toner composition comprised of a core comprised of pigments or dyes, and a polysiloxane-incorporated core binder resin, which core is encapsulated in a shell. In U.S. Ser. No. 445,221 there are illustrated processes with encapsulated toner compositions that are useful for generating documents inclusive of personal checks, which documents are subsequently processed in reader/sorter devices as illustrated herein. More specifically, there are illustrated in the aforementioned copending application processes for generating documents, which comprise the formation of images, such as latent images with a printing device especially devices generating from about 8 to about 135 prints per minute; developing the image with an encapsulated toner composition; subsequently transferring the developed image to a suitable substrate; permanently affixing the image thereto; and thereafter processing the documents in reader/sorters wherein image offsetting and image smearing are avoided or substantially reduced. Some examples of the aforementioned process wherein an encapsulated toner is not selected are illustrated in U.S. Pat. No. 4,517,268, especially column 3; the disclosure of this patent is totally incorporated herein. Examples of high speed ionographic printers, which can be utilized for the process of the copending application, the disclosure of which is totally incorporated herein by reference, include the Delphax S6000 TM printers and the commercially available Xerox Corporation 4060 TM. Thereafter, the formed documents with magnetic characters thereon are processed in reader/sorter apparatuses as illustrated herein.

One specific embodiment of the aforementioned copending application is directed to a process for obtaining images, which comprises the generation of a latent image and developing the latent images with a toner composition comprised of a core comprised of a polymer and pigment, such as magnetite, which core is encapsulated in a polymeric shell. In another embodiment of the copending application, there is provided an ionographic process which comprises the generation of a latent image comprised of characters; developing the image with an encapsulated magnetic toner comprised of a core comprised of a polymer and magnetite with a coercivity of from about 80 to about 250 Oersteds, and a remanence of from about 20 to about 70 Gauss, and wherein the core is encapsulated within a polymeric shell; and subsequently providing the developed image with magnetic ink characters thereon to a reader/sorter device whereby toner offsetting and image smearing is minimized in said device. Also encompassed by the aforementioned copending application are electrophotographic, especially xerographic, imaging and printing processes wherein the encapsulated toners disclosed herein are selected. Examples of suitable core polymers illustrated in the copending application and present in various effective amounts such as, for example, from about 20 percent by weight to about 40 percent by weight, include pressure fixable adhesive materials possessing a low glass transition temperature of from about −170° C. to about +25° C., and preferably from −100° C. to −10° C. can be selected for the toners of the present invention. The core polymer can be obtained by the in situ free radical polymerization of a core monomer or monomers up to, for example, 10, including acrylates and methacrylates, such as butyl acrylate, propyl acrylate, benzyl acrylate, pentyl acrylate, hexyl acrylate, cyclohexyl acrylate, dodecyl acrylate, ethoxy propyl acrylate, heptyl acrylate, isobutyl acrylate, methyl butyl acrylate, 2-ethoxyethyl acrylate, 2-butoxyethyl acrylate, 2-ethylbutyl acrylate, 2-ethylhexyl acrylate, 2-methoxypropyl acrylate, nonyl acrylate, octyl acrylate, m-tolyl acrylate, dodecyl methacrylate, hexyl methacrylate, isodecyl methacrylate, 2-ethoxyethyl methacrylate, octyl methacrylate, decyl methacrylate, tetradecyl methacrylate, octadecyl methacrylate, styrene, dodecyl styrene, hexyl methyl styrene, nonyl styrene, tetradecyl styrene, or other known vinyl monomers, reference for example U.S. Pat. No. 4,298,672, the disclosure of which is totally incorporated herein by reference, mixtures thereof; and the like. The core monomer is polymerized to obtain a polymer with, for example, a number average molecular weight ($M_n$) of from about 15,000 to about 100,000, and preferably from about 25,000 to about 60,000; and a ratio ($M_w/M_n$) of weight average molecular weight/number average molecular weight of greater than 2, and preferably from about 2.5 to about 4.0. Preferred core monomers, which are subsequently polymerized, include dodecyl methacrylate, octadecyl methacrylate, styrene, n-butyl acrylate and mixtures thereof.

There is a need for magnetic image character recognition (MICR) toners and processes enabling the generation of documents, such as personal checks, wherein toner offsetting and image smearing is avoided, or minimized. There is also a need for the generation of developed images including the generation of personal checks in laser printers or ionographic printers utilizing magnetic ink character recognition technology, wherein toner offset to protective foils present on the read and write heads is avoided or minimized, and image smearing is avoided or minimized. In addition, there is a need for MICR processes with a mixture of toners comprised of nonencapsulated toners, and encapsulated toners wherein toner offsetting to protective foils, and image smearing on documents generated is reduced or eliminated. There is also a need for MICR processes where the printed MICR characters do not offset to vinyl surfaces as, for example, where the MICR characters of a check document are in contact with window envelopes or vinyl check book covers. The processes of the present invention reduce or eliminate the offset to vinyl surfaces.

With the processes of the present invention, it is preferred in embodiment that the encapsulated toners have high, for example 40 to 65 weight percent of magnetite, and thus relatively low remanence magnetites are selected to provide the desired magnetic signal strength in the MICR reader. The aforementioned magnetite iron oxides can be more economical than the higher remanence magnetites which are selected for many MICR toners in which the loadings are substantially lower, for example 30 percent. There is a need for encapsulated toner compositions with many of the advantages illustrated herein. More specifically, there is a need for a mixture of toners and MICR processes thereof wherein image ghosting is eliminated or minimized. Also, there is a need for MICR processes and toners thereof which offer quality images with good fixing levels, for example over 70 percent at low fixing pressure of, for example, 2,000 psi. Moreover, there is a need for a mixture of toners, wherein image ghosting, and the like are avoided or minimized. Also, there is a need for a MICR toner mixture that has been surface treated with additives such as carbon blacks, graphite or the like to impart to their surface certain conductive characteristics such as providing a volume resistivity of from about $1\times10^3$ ohm-cm to about $1\times10^8$ ohm-cm. Furthermore, there is a need for a MICR toner mixture wherein surface additives such as metal salts or metal salts of fatty acids and the like are utilized to assist in the release of the images from the imaging component to the paper substrate.

SUMMARY OF THE INVENTION

It is an object of the present invention to provide magnetic image character recognition processes (MICR) with a mixture of toners, one of which is comprised of an encapsulated toner compositions with many of the advantages illustrated herein.

In another object of the present invention there are provided MICR processes utilizing a mixture of toners comprised of an encapsulated toner, and a toner free of encapsulation.

Another object of the present invention is the provision of MICR processes with a mixture of toners wherein image ghosting is eliminated in some embodiments, or minimized in other embodiments, wherein the mixture is comprised of a high fixable toner and a low smear, low coefficient of friction toner.

Further, another object of the present invention is the provision of MICR processes accomplished with a mixture of toners wherein toner agglomeration is completely eliminated.

Another object of the present invention is the provision of MICR processes accomplished with a mixture of toners with excellent flow properties.

Another object of the present invention is the provision of MICR processes with a mixture of an encapsulated toner and a toner without encapsulation that can be selected with cold pressure fixing systems.

Another object of the present invention is the provision of processes for generating documents suitable for MICR processes, such as personal checks, which processes are accomplished with a mixture comprised of encapsulated toner compositions and toner compositions free of encapsulation, and wherein toner offset to vinyl surfaces, such as window envelopes and vinyl check book covers, can be minimized.

Moreover, another object of the present invention is the provision of MICR processes accomplished with a mixture of toners, one of which is an encapsulated toner and wherein image offsetting is eliminated in some embodiments, or minimized in other embodiments.

It is an object of the present invention to provide toner and developer compositions, processes for obtaining images thereof, and particularly processes for generating documents, such as personal checks, which are subsequently processed in reader/sorters with many of the advantages illustrated herein.

Another object of the present invention resides in the provision of processes for generating documents, such as personal checks, suitable for magnetic ink character recognition, which processes are accomplished with a mixture of encapsulated toner compositions and toner compositions free of encapsulation.

In another object of the present invention there are provided processes for generating documents, such as personal checks, suitable for magnetic ink character recognition, which processes utilize mixtures of certain encapsulated toner compositions and toner compositions without encapsulation wherein toner offsetting, and image smearing is avoided or minimized.

Moreover, another object of the present invention relates to processes wherein toner offsetting to the read and write heads, including those that are not protected, or those that contain a protective foil thereon, is avoided or minimized.

In another object of the present invention, there are provided processes for processing documents wherein toner offsetting and image smearing are avoided or minimized.

Also, in another object of the present invention there are provided processes wherein, for example, image smearing and toner offsetting is avoided when documents, such as checks, containing magnetic characters thereon are utilized in commercial sorters, and/or reader/sorters.

Additionally, in yet another object of the present invention there are provided magnetic ink character recognition processes (MICR), which processes are suitable for the generation of documents, and wherein these checks can be utilized in commercial sorters, and/or reader/sorters, such as the IBM 3890 TM, without toner offsetting and image smearing.

In another important object of the present invention there are provided processes for generating documents, such as personal checks, suitable for magnetic image character recognition, and wherein the characters present on the documents are fused with a pressure roll, and wherein these documents can be utilized in commercial sorters such as the IBM 3890 TM and the NCR 6780 TM without toner offsetting and image smearing as illustrated herein.

These and other objects of the present invention can be accomplished by the provision of MICR processes and toners thereof. In one embodiment of the present invention, there are provided MICR processes accomplished with a mixture of toners one of which is comprised of an encapsulated toner comprised of a core of a polymer, or a plurality of polymers, and pigment, such as magnetite, wherein the core is encapsulated in a polymeric shell, reference for example the copending applications mentioned herein, and a toner free of encapsulation comprised of resin or a wax, or a mixture of resin and wax, where the total amount of resin and wax represents from, for example, about 20 to about 80 percent of the total toner by weight, pigment, such as magnetite, present in an amount of from about 20 to about 80 percent, optional charge additives, and optional surface additive components.

In one specific embodiment, the mixture of toners is comprised of an encapsulated toner present in an amount from about 5 to about 70 percent, and preferably from about 15 percent to about 50 percent by weight, and a toner free of encapsulation, such that the total percentage of the mixture comprised of toner with encapsulation and toner without encapsulation is about 100 percent.

The encapsulated toner compositions in one specific embodiment can be prepared by first dispersing the toner precursor component materials into stabilized microdroplets of controlled droplet size and size distribution, followed by shell formation around the microdroplets via interfacial polymerization, and subsequently generating the core polymer resin by in situ addition polymerization, preferably free radical polymerization within the newly formed microcapsules. The nonencapsulated toner can be prepared, for example, by mixing and heating a toner polymer, such as styrene methacrylate, or a sytrene butadiene and a pigment in a Banbury mixer, followed by micronization and classification to enable a toner with a particle diameter of from about 10 to about 20 microns. Extrusion processes can also be selected for the preparation of the nonencapsulated toner. Other known methods can be selected for the preparation of the encapsulated toner and the toner free of encapsulation.

Illustrative examples of specific encapsulated toners selected for the present invention are as illustrated herein and in U.S. Pat. Nos. 5,013,630 and 5,023,159, the disclosures of which are totally incorporated herein by reference, which toners are comprised of a core comprised of the polymer product of an addition monomer or monomers, and a functionalized organosilane, including polysiloxane, capable of undergoing copolymerization with the addition monomer or monomers, and more specifically wherein the core is comprised of an organosilane-modified polymer resin, and magnetic pigment particles; and a polymeric shell.

One encapsulated toner that may be selected for the MICR processes of the present invention is comprised of a soft core comprised of silane modified polymer resin, magnetite, and a polymeric shell thereover. Specifically, in one embodiment there is provided in accordance with the present invention MICR processes with a mixture of toners one of which is an encapsulated toner comprised of a core containing a silane-modified polymer resin preferably obtained by free radical polymerization, magnetite, and thereover a shell preferably obtained by interfacial polymerization.

Also, the encapsulated toner compositions selected can be as illustrated in U.S. Pat. No. 5,023,159, the disclosure of which is totally incorporated herein by reference, which toners are comprised of a core comprised of the polymer product of a monomer or monomers, and a polyfunctional organosilicon component, and more specifically wherein the core is comprised of a silane-modified polymer resin having incorporated therein an oxysilyl (I), a dioxysilyl (II), or a trioxysilyl (III) function of the following formula, pigment dye particles or mixtures thereof; and a polymeric shell.

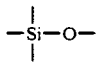
(I)

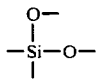
(II)

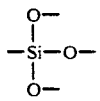
(III)

The aforementioned toners can be prepared by a number of different processes including the interfacial/-free radical polymerization process which comprises (1) mixing or blending of a core monomer or monomers, up to 25 in some embodiments, a functionalized organosilane, a free radical initiator or initiators, magnetite, and a shell monomer or monomers; (2) dispersing the resulting mixture of magnetite organic materials by high shear blending into stabilized microdroplets in an aqueous medium with the assistance of suitable dispersants or emulsifying agents; (3) thereafter subjecting the aforementioned stabilized microdroplets to a shell forming interfacial polycondensation; and (4) subsequently forming the core resin binder by heat induced free radical polymerization within the newly formed microcapsules. The shell forming interfacial polycondensation is generally accomplished at ambient temperature, but elevated temperatures may also be employed depending on the nature and functionality of the shell monomer selected. For the core polymer resin forming free radical polymerization, it is generally effected at a temperature of from ambient temperature to about 100° C., and preferably from ambient or room temperature, about 25° F. temperature, to about 85° F. In addition, more than one initiator may be utilized to enhance the polymerization conversion, and to generate the desired molecular weight and molecular weight distribution.

Illustrative specific examples of functionalized alkoxysilanes, chlorosilanes and siloxysilanes present in an effective amount, for example, in one embodiment in an amount of from 0.01 weight percent to about 20 weight percent of toner include (acryloxypropyl)methoxydimethylsilane, (acryloxypropyl)methyldichlorosilane, (acryloxypropyl)trimethoxysilane, (acryloxypropyl)trichlorosilane, (acryloxypropyl)methyl bis(-trimethylsiloxy)silane, (acryloxypropyl)tris-(trimethylsiloxy)silane, (methacryloxypropenyl)trimethoxysilane, (methacryloxypropyl)methyl bis(trimethylsiloxy)silane, (methacryloxypropyl)chlorodimethylsilane, (methacryloxypropyl)ethoxy-dimethylsilane, (methacryloxypropyl)methyldichlorosilane, (methacryloxypropyl)-methyldiethoxysilane, (methacryloxypropyl)trichlorosilane, (methacryloxypropyl)trimethoxysilane, (methacryloxypropyl)triethoxysilane, (methacryloxypropyl)tris(trimethysiloxy)silane, (styrylmethylaminopropyl)trimethoxysilane, (styrylmethylaminoalkyl)triethoxysilane, (styrylmethylaminoalkyl)methyldimethoxysilane, (styrylmethylaminoalkyl)methoxydimethylsilane, and the like, as illustrated in U.S. Ser. No. 524,952, the disclosure of which is totally incorporated herein by reference. The functionalized silanes are reacted with the shell monomer or monomers thereby preferably resulting in a core polymer thereof. Also, the silanes can be chemically grafted onto the surface of the pigment particles.

Examples of core monomers present in effective amounts, for example from about 20 to about 95 weight percent, selected include, but are not limited to, addition-type monomers such as propyl acrylate, propyl methacrylate, butyl acrylate, butyl methacrylate, hexyl acrylate, pentyl acrylate, pentyl methacrylate, hexyl acrylate, hexyl methacrylate, cyclohexyl acrylate, cyclohexyl methacrylate, lauryl acrylate, lauryl methacrylate, stearyl acrylate, stearyl methacrylate, benzyl acrylate, benzyl methacrylate, ethoxypropyl acrylate, ethoxypropyl methacrylate, heptyl acrylate, heptyl methacrylate, isobutyl acrylate, isobutyl methacrylate, methylbutyl acrylate, methylbutyl methacrylate, tolyl acrylate, tolyl methacrylate, styrene, dodecyl styrene, hexyl methyl styrene, nonyl styrene, tetradecyl styrene, other substantially equivalent addition monomers, and the like. Suitable functionalized organosilanes that may be selected as optional components for incorporation into the core polymer resin structure by reaction thereof with the monomer or monomers as well as to modify the surface of magnetite particles are alkoxysilanes, halosilanes, including preferably chlorosilanes, siloxysilanes containing an addition-polymerization functionality such as an acryloxy, methacryloxy, styryl group, and the like. The functionalized organosilane selected is capable of undergoing copolymerization with the core monomer or monomers up to, for example, 25 monomers may be selected in some embodiments. The functionalized alkoxysilane, halosilane including chlorosilane, siloxysilane or other functionalized organosilane with alkyl, alkoxy, chloro, siloxy, or the like, substituents can be employed in an effective amount of, for example, from about 0.01 to about 20 weight percent, and preferably from about 0.01 to about 10 weight percent of the toner.

The toner mixture, which comprises, for example, from about 30 to about 95 percent by weight, and preferably from about 50 to 85 percent by weight of encapsulated toner, and of from about 5 to about 70 percent by weight, and preferably from about 15 to 50 percent by weight of nonencapsulated toner, contains a nonencapsulated toner which may be comprised of the components illustrated herein, such as resin and pigment, wherein the known resin includes, but is not limited to, polyolefins, polyesters, polyurethanes, polyamides, epoxy resins, styrene acrylates, styrene methacrylates, styrene butadienes, and the like. Typical vinyl resins may be selected from homopolymers or copolymers of two or more vinyl monomers. Examples of known suitable vinyl monomers include styrene, nonyl styrene, ethylene, propylene, butylene, isobutylene, butadiene and other unsaturated olefins, vinyl chloride, vinyl bromide, vinyl acetate, vinyl benzoate, vinyl ethers such as vinyl ethyl ether, and vinyl methyl ether, vinyl esters such as methylacrylate, dodecylacrylate, stearyl acrylate, phenyl acrylate, methyl methacrylate, ethyl methacrylate and butyl methacrylate. Generally, the toner resin can be comprised of known styrene acrylates, styrene methacrylates, and styrene butadienes. Further, specific examples of suitable nonencapsulated toner resins are described in U.S. Pat. Nos. 4,517,268 and 4,859,550, the disclosures of which are totally incorporated herein by reference.

The nonencapsulated toner may also be comprised of a film forming material, such as a wax, which comprises from about 5 to about 80 percent by weight of the nonencapsulated toner, and preferably about 30 percent to about 60 percent by weight. Examples of waxes are illustrated herein and include those with a molecular weight average of from about 1,000 to about 20,000 and preferably from about 1,000 to about 6,000, such as polypropylene or polyethylene, reference British Patent 1,442,835, the disclosure of which is totally incorporated herein by reference. Further, illustrative examples of film forming materials or waxes which may be used as the nonencapsulated toner include, but are not limited to, solid waxes with melting points of from about 80° C. to about 180° C. Examples of suitable waxes which may be selected are aliphatic hydrocarbon waxes, such as polyethylene waxes, polypropylene waxes; polymeric alcohols; polyethylene glycols, fatty imide waxes, fatty nitrile waxes, fatty amide waxes, including ethylene or methylene bis-fatty amide waxes; copolymer waxes including, but not limited to, copolymers of ethylene, propylene, butadiene, acrylic acid, and vinyl acetate; chlorinated hydrocarbon waxes and natural waxes. The waxes may be linear, for example linear polymeric alcohols available from Petrolite Corporation, or they may be branched, for example HW 110P branched polyethylene wax. Examples of waxes suitable for nonencapsulated toner resins are described in U.S. Pat. No. 4,859,550, European Patent 0,078,175, and Japanese Patent 0242451, the disclosures of which are totally incorporated herein by reference. Some specific examples of waxes which may be selected include, but are not limited to $HOCH_2(CH_2)_nCH_2OH$ wherein n is a number of about 30 to about 500; $CH_3(CH_2)_nCH_2OH$ wherein n is a number of about 30 to about 500; polyethylene, polyethylene/vinyl acetate, polyethylene/propylene, or polyethylene/acrylic acid where the molecular weight is from about 1,000 to about 20,000; erucamide, oleamide, octadecamide, docosenamide, 1,2-ethanediylbis octadecenamide, N,N-dimethyl-dodecanamide, n-methyl-N-(1-oxooctadecyl)-glycine, N,N-bis(2-hydroxyethyl)dodecanamide, dodecanamine, tetradecanamine, octadecanamine, docosanamine, N-dodecyl-1-dodecanamine, n-hexadecyl-hexadecanamine, and dicoco amine.

Toner compositions comprised of resin, pigment, and charge additives are illustrated in a number of U.S. patents including U.S. Pat. No. 4,560,635 wherein a positively charged dry toner with resins such as styrene copolymers, pigments such as carbon black, magnetite, or mixtures-thereof, and the charge additive distearyl dimethyl ammonium methyl sulfate are disclosed. The toners of this patent and other similar known toners, such as those illustrated in U.S. Pat. Nos. 4,298,672; 4,338,390 and 3,590,000, may be selected as the toner free encapsulation for the toner mixture of the present invention.

Other toners without encapsulation which may be selected for the present invention are described in U.S. Pat. No. 4,517,268, the disclosure of which is totally incorporated herein by reference, where there is illustrated a process for generating documents such as personal checks suitable for magnetic image character recognition, which process involves generating documents in high speed electronic laser printing devices. The developer composition disclosed in this patent is comprised of, for example, magnetic particles, such as known magnetites, like Mapico Black, certain styrene resin particles, and carrier particles as illustrated in the Abstract of the Disclosure. Additive particles may also be included in the developer compositions of this patent. The toners of this patent and other similar known toners can be selected as the toner without encapsulation for the toner mixture of the present invention.

Also, toners without encapsulation which may, it is believed, be selected for the present invention are illustrated in U.S. Pat. No. 4,883,736, the disclosure of which is totally incorporated herein by reference, including magnetic single component, and colored toner compositions containing certain polymeric alcohol waxes. More specifically, there is disclosed in this patent the elimination of toner spots, or comets with developer compositions comprised of toner compositions containing resin particles, particularly styrene butadiene resins, pigment particles such as magnetites, carbon blacks or mixtures thereof, polymeric hydroxy waxes available from Petrolite, which waxes can be incorporated into the toner compositions as internal additives or may be present as external components; and optional charge enhancing additives, particularly, for example, distearyl dimethyl ammonium methyl sulfate, reference U.S. Pat. No. 4,560,635, the disclosure of which is totally incorporated herein by reference, and carrier particles.

Also, examples of other toners without encapsulation which may be selected for the present invention are illustrated in U.S. Pat. No. 4,859,550, the disclosure of which is totally incorporated herein by reference, wherein there is illustrated a process for generating documents, such as personal checks, suitable for magnetic image character recognition, which process involves generating documents in high speed electronic laser printing devices. The toner composition disclosed in this patent is comprised of, for example, magnetic particles, such as magnetite, certain styrene resin particles, and an additive component comprised of an aliphatic hydrocarbon of a polymeric alcohol of the formula $$CH_3(CH_2)_nCH_2OH$$

wherein n is a number of about 30 to about 500. Specifically, there is disclosed the minimization of toner offsetting and image smearing in a reader/sorter device.

Other additives, such as internal or external additives for image release, triboelectric charge control, conductivity, and flow properties may also be included in the encapsulated toner, and in the toners without encapsulation. Illustrative examples of additives that can be selected for the encapsulated and unencapsulated toner compositions of the present invention include, for example, metal salts, metal salts of fatty acids, colloidal silicas, mixtures thereof, and the like, which additives are usually present in an amount of from about 0.1 to about 1 weight percent, reference U.S. Pat. Nos. 3,590,000; 3,720,617; 3,655,374 and 3,983,045, the disclosures of which are totally incorporated herein by reference. Preferred additives usually present on the toner surface include zinc stearate and Aerosil® R972. Other specific surface additives which may be selected in effective amounts of, for example, from about 1 to about 10 weight percent are components such as carbon blacks, graphite, copper iodide, and other conductive metal salts, conductive organic or organometallic materials.

Examples of toners free of encapsulation which can be selected for the present invention are, for example, the Xerox Corporation 4060 TM dry ink, and toners described in Japanese Patent Publication 0242451, the disclosure of which is totally incorporated herein by reference. These toners free of encapsulation may be mixed with encapsulated toners as described herein, such that the toner free of encapsulation is present in an amount of about 5 to 70 percent by weight and preferably about 15 to 50 percent by weight, and the encapsulated toner is present in an amount of 30 to 95 percent by weight, and preferably of about 50 to 85 percent by weight.

The toner free of encapsulation may contain charge enhancing additives as illustrated in the patents mentioned herein, such as distearyl dimethyl ammonium methyl sulfate, and the like. From about 0.1 to about 10 weight percent of charge additive is usually selected. Also, the toner may contain on its surface additives such as metal salts of fatty acids, such as zinc stearate, magnesium stearate, and the like; and silicas such as Aerosils®, like Aerosil® R972. The surface additives can be present in effective amounts of, for example, from about 0.05 to about 3 weight percent.

Various known magnetites present in the core of the encapsulated toner, and in the polymer of the unencapsulated toner in an effective amount of, for example, from about 20 to about 80 percent by weight of toner, and preferably in an amount of from about 40 to about 65 weight percent that can be selected include magnetites MO8029, MO8060, Columbian magnetites, MAPICO BLACKS TM and surface treated magnetites, for example, BASF Carbonyl Iron CT, and Bayer AC 5130, Pfizer magnetites CB4799, CB5300, CB5600, MCX6369, Bayer magnetites, Bayferrox 8600, 8610, Northern Pigments magnetites, NP-604, NP-608, Magnox magnetites TMB-100, or TMB-104, and other equivalent magnetites. Known carbon blacks, such as REGAL 330® carbon black and the like, and colored pigments such as cyan, magenta, yellow and the like, may be selected as a pigment for the toner free of encapsulation.

Examples of shell polymers for the encapsulated toner include polyureas, polyamides, polyesters, polyurethanes, mixtures thereof, and other similar polycondensation products. The shell amounts are generally from about 5 to about 30 weight percent of toner, and have a thickness generally, for example, of less than about 5 microns, and more specifically from about 0.1 micron to about 3 microns. Other shell polymers, shell amounts, and thicknesses can be selected provided the objectives of the present invention are achievable.

The shell forming monomer components present in the organic phase are preferably comprised of diisocyanates, diacyl chloride, bischloroformate, together with appropriate polyfunctional crosslinking agents such as triisocyanate, triacyl chloride, and the like. Illustrative examples of the shell monomer components include benzene diisocyanate, toluene diisocyanate, diphenylmethane diisocyanate, cyclohexane diisocyanate, hexane diisocyanate, adipoyl chloride, fumaryl chloride, suberoyl chloride, succinyl chloride, phthaloyl chloride, isophthaloyl chloride, terephthaloyl chloride, ethylene glycol bischloroformate, diethylene glycol bischloroformate, and the like. The water soluble, shell forming monomer components which are preferably added to the aqueous phase can be a polyamine or polyol, including bisphenols, the nature of which is dependent on the shell characterization desired, for example. Illustrative examples of water soluble shell monomers that react with the aforementioned diisocyanates, and the like include ethylenediamine, triethylenediamine, diaminotoluene, diaminopyridine, bis(aminopropyl)piperazine, bisphenol A, bisphenol Z, and the like. When desired, a water soluble crosslinking component, such as triamine or triol, can also be added to improve the mechanical strength of the shell structure.

In one specific embodiment of the present invention, there are provided MICR processes with a mixture of toners, one of which is an encapsulated toner prepared by the known mixing, and dispersing of a core monomer or monomers, a functionalized organosilane, a free radical initiator, pigment particles or dyes, and a shell monomer component into microdroplets of specific droplet size and size distribution in an aqueous medium containing a dispersant or stabilizer, wherein the volume average diameter of the microdroplet is preferably from about 5 microns to about 30 microns, and its volume average droplet size dispersity is preferably from about 1.2 to about 1.4 as determined from Coulter Counter measurements of the microcapsule particles after encapsulation; forming a microcapsule shell around the microdroplets via interfacial polymerization by adding a water soluble shell forming monomer component; and subsequently affecting a free radical polymerization to form a core resin binder within the newly formed microcapsules by, for example, heating the reaction mixture from room temperature to about 100° C. for a period of from about 1 to about 10 hours. Stabilizers selected for the process include water soluble polymers such as poly(vinyl alcohols), methyl cellulose, hydroxypropyl cellulose and the like. Illustrative examples of free radical initiators selected for the preparation of the encapsulated toners include azo compounds such as 2-2'-azodimethylvaleronitrile, 2-2'-azoisobutyronitrile, azobiscyclohexane-nitrile, 2-methylbutyronitrile or any combination of these azo compounds with the quantity of initiator(s) being, for example, from about 0.5 percent to about 10 percent by weight of that of core monomer(s). Interfacial polymerization processes selected for the toner shell formation and shells thereof are as illustrated, for example, in U.S. Pat. Nos. 4,000,087 and 4,307,169, the disclosures of which are totally incorporated herein by reference.

An illustrative process for the preparation of the encapsulated toner particles of the present invention is described in U.S. Pat. No. 4,727,011, the disclosure of which is totally incorporated herein by reference. One preparation process involves dispersion of a magnetic colorant with a polytron homogenizer in a mixture of hydrophobic liquids such as a polyisocyanate, a core monomer and an initiator; subsequent dispersion of the above pigmented organic medium in an aqueous medium containing a hydrophilic protective colloid thereby generating a stable particle suspension; adding a water soluble shell component to produce shells around the core material particles; and heating of the reaction mixture to polymerize the core monomer. Subsequently, the encapsulated toner is washed with water by decantation to remove unreacted water soluble shell component and protective colloid. The toner slurry is now suitable for a subsequent drying procedure. Toner compositions with a conductivity of $10^{-4}$ to $10^{-8}$ $ohm^{-1}$ $cm^{-1}$ for inductive development are prepared by spray drying, using a commercially available Yamato DL-41, the aforementioned toner slurry together with Aquadag E TM (Acheson Colloids Ltd.), a water based dispersion of conductive colloidal graphite (20 weight percent), containing a polymeric binder (2 weight percent). Spray drying can be accomplished in an air inlet temperature of 150° C. to yield an encapsulated toner as a free flowing powder with conductivity in the range of about $10^{-4}$ to about $10^{-8}$ $ohm^{-1}$ $cm^{-1}$. Depending on the particle size of the toner, about 1 to about 2 parts of colloidal graphite for 100 parts of the toner are selected to impart the desired conductivity. For example, a toner of particle size average diameter of 18 microns requires 1.2 parts of Aquadag E TM to 100 parts of the toner to impart a conductivity of $10^{-6}$ $ohm^{-1}$ $cm^{-1}$.

Also, the toner compositions, particularly the encapsulated toner, can be rendered conductive with, for example, a volume resistivity, which can be measured in a cell test fixture at 10 volts of from about $1\times10^3$ ohm-cm to about $1\times10^8$ ohm-cm by adding in effective amounts of, for example, from about 1 to about 10 weight percent to the surface thereof components such as carbon blacks, graphite, copper iodide, and other conductive metal salts, conductive organic or organometallic materials.

Specifically, in an embodiment of the present invention there are provided processes for generating documents, which comprise the formation of images, such as latent images with a printing device, especially devices generating from about 8 to about 135 prints per minute; developing the image with the toner mixture comprised of an encapsulated toner and a toner free of encapsulation; subsequently transferring the developed image to a suitable substrate; permanently affixing the image thereto; and thereafter processing the documents in reader/sorters wherein image offsetting and image smearing are avoided or substantially reduced. Some examples of the aforementioned process wherein an encapsulated toner is not selected are illustrated in U.S. Pat. No. 4,517,268, expecially column 3, the disclosure of which is totally incorporated herein. Examples of high speed ionographic printers, which can be utilized for the process of the present invention, include the Delphax S6000 TM printers and the commercially available Xerox Corporation 4060 TM. Thereafter, the formed documents with magnetic characters thereon are processed in reader/sorter apparatuses as illustrated herein.

In an embodiment of the present invention, there is provided an ionographic process which comprises the generation of a latent image comprised of characters; developing the image with a mixture of toners comprised of an encapsulated magnetic toner as illustrated herein and wherein the magnetite selected has a coercivity of from about 80 to about 250 Oersteds, and a remanence of from about 20 to about 70 Gauss; and wherein the core is encapsulated within a polymeric shell and a waxy toner free of encapsulation; and subsequently providing the developed image with magnetic ink characters thereon to a reader/sorter device whereby toner offsetting and image smearing is minimized in said device. Preferred for the encapsulated toners are magnetites with a coercivity of from about 80 to about 160 Oersteds and a low remanent magnetic moment of from about 25 to about 55 Gauss.

Encapsulated shells are as illustrated, for example, in U.S. Pat. No. 4,877,706, which shells are obtained by the reaction of a first component comprised of polyisocyanates available from Dow Chemical Company, including for example PAPI TM 27, PAPI TM 135, PAPI TM 94, PAPI TM 901, Isonate TM 143L, Isonate TM 181, Isonate TM 125M, Isonate TM 191, and Isonate TM 240; and a second amine component selected, for example, from the group consisting of ethylenediamine, tetramethylenediamine, pentamethylenediamine, hexamethylenediamine, p-phenylenediamine, m-phenylenediamine, 2-hydroxy trimethylenediamine, diethylenetriamine, triethylenetetraamine, tetraethylenepentaamine, 1,8-diaminooctane, xylylene diamine, bis(hexamethylene)triamine, tris(2-aminoethyl)amine, 4,4'-methylene bis(cyclohexylamine), bis(3-aminopropyl)ethylene diamine, 1,3-bis(aminomethyl)-cyclohexane, 1,5-diamino-2-methylpentane, piperazine, 2-methylpiperazine, 2,5-dimethylpiperazine, and 1,4-bis(3-aminopropyl)piperazine. Generally, the shell polymer comprises from about 6 to about 25 percent by weight of the total toner composition, and preferably comprises from about 12 percent by weight to about 18 percent by weight of the toner composition. During the aforementioned interfacial polymerization to form the shell, the temperature is maintained at from about 15° C. to about 55° C., and preferably from about 20° C. to about 30° C. Also, generally the reaction time is from about 1 minute to about 5 hours, and preferably for about 20 minutes to about 90 minutes. Other temperatures and times can be selected, and further polyisocyanates and amines not specifically illustrated may be selected. Specific examples of shells include those comprised of the interfacial polycondensation reaction of a first polyisocyanate component and a second amine component, and wherein said toner includes thereon an electroconductive material obtained from a water based dispersion of said material in a polymeric binder, said first polyisocyanate component being selected from the group consisting of PAPI TM 27, PAPI TM 135, PAPI TM 94, PAPI TM 901, Isonate TM 143L, Isonate TM 181, Isonate TM 125M, Isonate TM 191, and Isonate TM 240; and said second amine component selected from the group consisting of ethylenediamine, tetramethylenediamine, pentamethylenediamine, hexamethylenediamine, p-phenylenediamine, m-phenylenediamine, 2-hydroxy trimethylenediamine, diethylenetriamine, triethylenetetraamine, tetraethylenepentaamine, 1,8-diaminooctane, xylylene diamine, bis(hexamethylene)-triamine, tris(2-aminoethyl)amine, 4,4'-methylene bis(-cyclohexylamine), bis(3-aminopropyl)ethylene diamine, 1,3-bis(aminomethyl)cyclohexane, 1,5-diamino-2-methylpentane; and piperazine, 2-methylpiperazine, 2,5-dimethylpiperazine, and 1,4-bis(3-aminopropyl)piperazine. Generally, the isocyanate is selected in an amount of from about 5 percent by weight to about 20 percent by weight, and preferably in an amount of from about 8 percent by weight to about 12 percent by weight. Moreover, the polyisocyanate can be comprised of a mixture containing compounds having at least two isocyanate groups with an average functionality of from about 2 to about 4, and preferably from about 2.0 to about 2.6, which mixtures contain, for example, from about 0.1 percent by weight to about 11.9 percent by weight of a first polyisocyanate containing an average functionality of 2.6, and from about 0.1 percent by weight to about 11.9 percent by weight of a second polyisocyanate containing a functionality of 2.0.

Other isocyanates may perhaps be selected for reaction with the amine to enable formation of the shell by interfacial polymerization, reference for example U.S. Pat. No. 4,612,272, and U.K. Patents 2,107,670 and 2,135,469, the disclosures of which are totally incorporated herein by reference.

Specific illustrative examples of water soluble amine compounds, which are capable of polymerizing interfacially with the abovementioned isocyanate compounds to form a durable capsule shell, include:

(1) polyamines—ethylenediamine, tetramethylenediamine, pentamethylenediamine, hexamethylenediamine, p-phenylenediamine, m-phenylenediamine, 2-hydroxy trimethylenediamine, diethylenetriamine, triethylenetetraamine, tetraethylenepentaamine, 1,8-diaminooctane, xylylene diamine, bis(hexamethylene)triamine, tris(2-aminoethyl)amine, 4,4'-methylene bis(cyclohexylamine), bis(3-aminopropyl-)ethylene diamine, 1,3-bis(aminomethyl)cyclohexane, 1,5-diamino-2-methylpentane;

(2) piperazines—piperazine, 2-methylpiperazine, 2,5-dimethylpiperazine, 1,4-bis(3-aminopropyl)piperazine; and the like.

As a preferred shell material, there is selected the interfacial polycondensation product of Isonate TM 143L and 1,4-bis(3-aminopropyl)piperazine in the molar ratios of from about 1:1 to about 1:1.2, and preferably from about 1:1.03 to about 1:1.1; and PAPI TM 94 and 1,4-bis(3-aminopropyl)piperazine in the molar ratios of from about 1:1 to about 1:1.3, and preferably from about 1:1.1 to about 1:1.2.

The following examples are being submitted to further define various species of the present invention. These examples are intended to be illustrative only and are not intended to limit the scope of the present invention. Also, parts and percentages are by weight unless otherwise indicated. Comparative data and Examples are also provided.

General Evaluation and Characterization Methods and Conditions

Unless otherwise noted, particle sizes were determined on dry toner samples using a Coulter Counter Model ZM, available from Coulter Electronics, Inc. Toner volume resistivity was measured on powdered samples, which were packed in a 1 $cm^3$ cell using a horseshoe magnet placed beneath the cell. Two opposite walls of the cell are comprised of 1 centimeter × 1 centimeter conductive metal plates. The other walls and the bottom of the cell are 1 centimeter × 1 centimeter, and are comprised of an insulating material. A voltage of 10 volts is applied across the plates, and the current flow through the plates is measured using an electrometer.

The prepared toners were evaluated in a Xerox Corporation 4060 TM printer with the transfix pressure adjusted to either 2,000 psi or 4,000 psi. Print quality was evaluated from a checkerboard print pattern. The image optical density was measured with a standard integrating densitometer. Image fix was measured by the standardized tape pull method, and is expressed as a percentage of the retained image optical density after the tape test relative to the original image optical density. Image ghosting was evaluated by visually observing for multiple ghost images on the document by visual inspection.

For the MICR evaluation, the magnetically encoded check documents were produced using the 4060 TM or S6000 TM printer. The magnetic characters were generated in accordance with the E13-B font, the standard as defined by the American National Standards Institute (ANSI). The magnetic signals from the documents were tested using the MICR-MATE I check reader obtained from Checkmate Electronics, Inc. The ANSI standards for MICR documents are 50 to 200 percent nominal magnetic signal in an E13-B font with the preferred range of about 120 to about 150 percent nominal for the MICR "On-Us" character.

Tests simulating image offset, such as occurs in the IBM 3890 TM reader/sorter, which contains a protective foil on the read and write heads, were evaluated by applying a reproducible standard pressure between a protective foil and a printed image at speeds equivalent to a reader/sorter operating at 2,500 checks/minute. Image offset to the protective foil, as occurs in the IBM 3890 TM reader/sorter, was measured either visually, or as mass of toner offset to the foil. The measured image offset to the protective foil is the equivalent of about 10 passes of 800 checks. A reduced image offset to the foil in this test is expected to result in reduced reader/sorter maintenance due to the reduction or elimination of toner offset to protective foils. Other tests simulating image offset, such as occurs in the IBM 3890 TM reader/sorter, which contains a protective foil on the read and write heads, and the NCR 670 TM which does not contain a protective foil, were evaluated by applying a reproducible standard pressure between a piece of Xerox 4024 TM paper and a printed image at speeds equivalent to a reader/sorter operating at 2,500 checks/minute. Image offset to the paper, which simulates image offset occuring in the reader/sorter, was measured as the mass of toner offset to the paper. The image friction coefficient against paper at 2,500 checks/minute was also measured using this test. It is known that the image offset to the paper in this test correlates to the image offset in both reader/sorters with and without protective foil. It is also known that the image friction coefficient to the paper correlates to the image offset in both reader/sorters with and without protective foil with lower friction coefficients being related to lower image offset, and to lower reject rates in many types of reader/sorters. Check documents were also processed on an NCR 675 TM reader/sorter, which does not contain a protective foil. Checks were processed at 750 checks/minute, and toner image wear was evaluated by visual inspection after 1 to 10 passes.

EXAMPLE I

An 18.6 micron average diameter conductive black encapsulated toner comprising a poly(lauryl methacrylate) core resin and NP608 magnetite was prepared as follows.

A mixture of 134.75 grams of lauryl methacrylate, available as Rocryl TM 320 from Rohm and Haas Company, 2.62 grams each of 2,2'-azobis(2,4-dimethylvaleronitrile) and 2,2'-azobis-(isobutyronitrile), and a solution of 47.1 grams of Isonate TM 143L in 20 milliliters of dichloromethane was mixed in a 2-liter Nalgene container with an IKA-T50 polytron equipped with a G45/M probe at 4,000 rpm for 30 seconds. Two hundred and eighty (280) grams of NP608 magnetite was then added, and the resulting mixture was homogenized by high sheer blending with the IKA polytron at 8,000 rpm for 4 minutes. To the mixture was then added 1 liter, 0.10 percent (by weight), of an aqueous poly(vinyl alcohol) (88 percent hydrolyzed; MW, molecular weight average of 96,000) solution, and thereafter, the mixture was blended at 9,000 rpm with an IKA polytron equipped with a G45/M probe for 2 minutes. This mixture was then transferred to a 2 liter reactor vessal and a solution of 29.5 grams of α-D Glucose in 80 milliliters of water was then added with constant stirring for 10 minutes to initiate the microcapsule shell forming reaction. Subsequently, the mixture was transferred to a 2 liter reaction kettle and was mechanically stirred at room temperature for approximately 1 hour to complete the shell forming polycondensation reaction. Thereafter, the mixture was heated in an oil bath to initiate the core binder forming free radical polymerization. The temperature of the mixture was gradually raised from room temperature to a final temperature of 85° C. over a period of 1 hour. Heating was continued at this temperature for an additional 6 hours, and thereafter the mixture was cooled down to room temperature. The microcapsule toner product formed was then transferred to a 4-liter beaker, and washed repeatedly with water until the washing was clear, and the product was then sieved through a 180 micron sieve to remove coarse material. The resulting wet toner was transferred to a 2-liter beaker and was diluted with water to a total volume of 1.8 liter. Colloidal graphite, 19.9 grams, available as Aquadag E TM from Acheson Colloids, diluted with 100 milliliters of water, was added to the beaker, and the mixture was spray dried in a Yamato Spray Dryer at an air inlet temperature of 160° C., and an air outlet temperature of 80° C. The air flow was retained at 0.75 $m^3$/minute, while the atomizing air pressure was kept at 1.0 killigram/$cm^2$. The collected encapsulated dry toner (260 grams) was then screened through a 63 micron sieve. The encapsulated toner's volume average particle diameter, as measured on a 256 channel Coulter Counter, was 18.6 microns with a volume average particle size dispersity of 1.37.

Two hundred and forty (240) grams of the above dry toner material was dry blended with a Greey blender, first with 0.96 gram of carbon black (Black Pearls TM 2000) for 2 minutes with the blending impeller operating at 3,500 RPM, and then with 3.6 grams of zinc stearate for another 6 minutes at an impeller speed of 3,000 RPM. The latter blending was continued until the volume resistivity of toner was from about $5\times10^4$ to about $5\times10^6$ ohm-cm. For this toner, the final volume resistivity was $6.3\times10^4$ ohm-cm as measured in a cell fixture at 10 volts. After dry blending, the toner was further sieved through a 63 micron sieve.

The toner without encapsulation, about 11 micron in average particle diameter, is commercially available from Xerox Corporation as 4060 TM dry ink, and was comprised in this Example of about 60 weight percent of styrene-n-butylmethacrylate (58/42) and 40 weight percent of Mapico Black TM magnetite obtained from Columbian Chemicals. Toner mixtures with amounts of 5 to 30 percent by weight of nonencapsulated toner, and 95 to 70 percent by weight of encapsulated toner were prepared by roll milling the encapsulated toner and toner without encapsulation together for one minute at 120 feet/minute. The above prepared toners were evaluated in a Xerox Corporation 4060 TM printer. The developed images were transfixed at 55° C. with a transfix pressure of 2,000 psi. The image fix of the encapsulated toner was 90 percent. The image fix of the toner without encapsulation was 24 percent. The image fix of the mixture of 70 percent of encapsulated and 30 percent of toner without encapsulation was 74 percent. Personal check documents with MICR characters were also printed in the same manner using the 70 to 30 toner. The magnetic signal for the MICR "On-Us" character on these check documents was tested using the MICR-MATE I check reader, and provided a value of 128 to 135 percent nominal. Neither the encapsulated toner nor the mixture of encapsulated toner and toner without encapsulation showed a detectable image smear after 10 passes against IBM 3890 TM reader/sorter protective foil at 2,500 checks/minute. After 10 passes through an NCR 675 TM reader/sorter, which does not contain a protective foil, the toner with encapsulation showed some image wear as did toner images made according, for example, to the processes as described in U.S. Pat. No. 4,517,268, reference Example I, which comprise conventional melt blended toner compositions, while the toner without encapsulation showed very high image wear as shown by loss of the integrity of the MICR characters on the check document. The mixture of toners showed no detectable image wear under this test illustrating the advantage of the inventive toner mixture over the encapsulated toner alone for MICR documents. Images made from the 70 to 30 toner mixture, and worn by abrasion with a piece of paper at 2,500 checks/minute, showed a fifty fold decrease in the amount of toner offset to paper compared to the encapsulated toner alone, and a drop in the coefficient of friction of the toner image from 0.75 to 0.26. In comparison, the friction coefficient for toner images made by the processes as described in U.S. Pat. No. 4,517,268 was 0.39. The reduction in image wear at 2,500 checks/-minute and the coefficient of friction against paper are related to lower image wear and toner smear and toner offset in a reader/sorter. This is an illustration of the advantage of the inventive toner mixture over the encapsulated toner alone for MICR documents.

EXAMPLE II

The preparation of a 20.6 micron conductive black encapsulated toner with a lauryl methacrylate polymeric core resin and NP608 magnetite is illustrated in the following example.

A mixture of 134.75 grams of lauryl methacrylate, 2.62 grams each of 2,2'-azobis(isobutyronitrile) and 2,2'-azobis(2,4-dimethylvaleronitrile), and 47.1 grams of Isonate TM 143L was mixed by high shear blending using an IKA-T50 polytron equipped with a G45/M probe at 4,000 rpm for 30 seconds. To the resulting clear organic mixture was added 280 grams of NP608 magnetite, and the mixture was homogenized for 4 minutes at 8,000 rpm using the aforementioned IKA probe. One liter of 0.09 percent (by weight) of aqueous poly(vinyl alcohol) was then added, and the mixture was homogenized at 9,000 rpm for 2 minutes with the IKA polytron. To the resulting suspension was added a solution of 37 milliliters of 1,4-bis(3-aminopropyl)piperazine in 80 milliliters of water, and the mixture was transferred to a 2-liter reaction kettle equipped with a mechanical stirrer and a temperature probe. The mixture was stirred at room temperature for 1 hour, and was subsequently heated in an oil bath over a period of 1 hour to a final reaction temperature of 85° C. Heating was continued at this temperature for an additional 6 hours. The reaction mixture was then worked up according to the procedure of Example I except that 18.1 grams of Aquadag E TM was employed during the spray drying stage. There were obtained 286 grams of dry encapsulated toner. The volume average particle diameter of the toner was 20.6 microns with a volume average particle size dispersity of 1.4. The toner was then dry blended to yield a final volume resistivity of $1\times10^6$ ohm-cm with the cell of Example I.

The toner free of encapsulation was comprised of the same components as the toner of Example I. Toner mixtures with amounts of 30 percent by weight of nonencapsulated toner, and 70 percent by weight encapsulated toner were prepared by roll milling the encapsulated toner and toner without encapsulation together for one minute at 120 feet/minute. The above prepared toner was evaluated in a Xerox Corporation 4060 TM printer. The developed images were transfixed at 55° C. with a transfix pressure of 2,000 psi. The image fix of the encapsulated toner was 82 percent. The image fix of the toner without encapsulation was 24 percent. Toner mixtures with varying proportions of encapsulated toner and toner without encapsulation were tested by measuring the friction coefficient of the image and the image offset to paper at 2,500 checks/minute. Personal check documents with MICR characters were also printed in the same manner using these toners. The magnetic signal for the MICR "On-Us" character on these check documents was tested using the MICR-MATE I check reader, and provided values of 120 to 135 percent nominal. The advantage of the inventive toner mixtures over the encapsulated toner alone for MICR documents is further illustrated in the Table. The image fix of the optimum mixture of 70 percent of encapsulated toner and 30 percent of toner without encapsulation was 64 percent. Images made from the 30 to 70 toner mixture showed only 3 percent of the amount of toner offset to paper compared to the encapsulated toner alone, and a drop in the coefficient of friction of the toner image from 0.82 to 0.36 for the encapsulated toner above.

TABLE

Toner offset and friction coefficient for encapsulated toner with varying proportions of toner without encapsulation:

| Percent by Weight of Toner Without Encapsulation | Friction Coefficient of Toner Image | Toner Offset to Paper at 2,500 Checks/Minute (mg of toner) |
|---|---|---|
| 0 | 0.82 | 17.4 |
| 5* | 0.77 | 8.3 |
| 10* | 0.70 | 4.0 |
| 20* | 0.58 | 1.5 |

TABLE-continued

Toner offset and friction coefficient for encapsulated toner with varying proportions of toner without encapsulation:

| Percent by Weight of Toner Without Encapsulation | Friction Coefficient of Toner Image | Toner Offset to Paper at 2,500 Checks/Minute (mg of toner) |
|---|---|---|
| 30* | 0.41 | 0.5 |
| 50* | 0.36 | 0.5 |

*Remainder is encapsulated toner, 95, 90, 80, 70 and 50.

EXAMPLE III

A 19.1 micron conductive black encapsulated toner with a flouro modified poly(lauryl methacrylate) core resin and Northern Pigment magnetite NP-608 was prepared by the following procedure.

An encapsulated toner was prepared by repeating the procedure of Example I with the exception that 120 grams of lauryl methacrylate, 13.34 grams of fluoromethacrylate, 3.32 grams each of 2,2'-azobis(isobutyronitrile) and 2,2'-azobis(2,4-dimethylvaleronitrile) and 280 grams of Northern Pigments magnetite NP-608, were employed. In addition, 1 liter of 0.12 percent (by weight) of aqueous solution of poly(vinyl alcohol) was selected. The reaction mixture was then worked up according to the procedure of Example I except that 21.2 grams of Aquadag E TM was employed during the spray drying stage. There resulted 386 grams of dry encapsulated toner. The toner's volume average particle diameter was 19.1 microns with a volume average particle size dispersity of 1.28.

The toner without encapsulation was commercially available from Xerox Corporation as 4060 TM dry ink, reference Example I. Toner mixtures with amount of 5 to 50 percent by weight nonencapsulated toner, and 50 to 95 percent by weight encapsulated toner were prepared by roll milling the encapsulated toner and toner without encapsulation together for one minute at 120 feet/minute. The above prepared toners were evaluated in a Xerox Corporation 4060 TM printer. The developed images were transfixed at 55° C. with a transfix pressure of 4,000 psi. The image fix of the encapsulated toner was 87 percent. The image fix of the toner without encapsulation was 36 percent. The image fix of the mixture of 70 percent of encapsulated and 30 percent of toner without encapsulation was 84 percent. Personal check documents with MICR characters were also printed in the same manner using these toners. The magnetic signal for the MICR "On-Us" character on these check documents was tested using the MICR-MATE I check reader, and provided values of 125 to 130 percent nominal. Images made from the toner mixture, and worn by abrasion with a piece of paper at 2,500 checks/minute showed a reduction of fifty times in the amount of toner offset to paper compared to the encapsulated toner alone, and a drop in the coefficient of friction of the toner image from 0.55 to 0.22.

EXAMPLE IV

An 19.8 micron conductive black encapsulated toner comprising a silane-modified poly(lauryl acrylate) core resin and Columbian magnetite was prepared as follows.

An encapsulated toner was prepared in accordance with the procedure of Example I except that 108.8 grams of lauryl acrylate, 280 grams of CB4799 magnetite, 12.1 grams of Siloxane A (from Petrarch Chemicals), 2.26 grams each of 2,2'-azobis(isobutyronitrile) and 2,2'-azobis(2,4-dimethylvaleronitrile) and 0.20 percent of aqueous poly(vinyl alcohol) solution were utilized. A total of 227 grams of dry encapsulated toner product was obtained. The volume average particle diameter for the toner obtained was 19.8 microns with a volume average particle size dispersity of 1.5.

The toner without encapsulation was commercially available from Xerox Corporation 4060 TM dry ink, reference Example I. Toner mixtures with amounts of 5 to 50 percent by weight nonencapsulated toner, and 50 to 95 percent by weight encapsulated toner were prepared by roll milling the encapsulated toner and toner without encapsulation together for one minute at 120 feet/minute. The above prepared toners were evaluated in a Xerox Corporation 4060 TM printer. The developed images were transfixed at 55° C. with a transfix pressure of 4,000 psi. The image fix of the encapsulated toner was 75 percent. The image fix of the toner without encapsulation was 36 percent. The image fix of the mixture of 70 percent of encapsulated and 30 percent of toner without encapsulation was 70 percent. Personal check documents with MICR characters were also printed in the same manner using these toners. The magnetic signal for the MICR "On-Us" character on these check documents was tested using the MICR-MATE I check reader, and provided values of 150 to 170 percent nominal. Images made from the toner mixture, and worn by abrasion with a piece of paper at 2,500 checks/minute showed a reduction of ten times in the amount of toner offset to paper compared to the encapsulated toner alone, and a drop in the coefficient of friction of the toner image from 0.68 to 0.25. This is an illustration of the advantage of the inventive toner mixture over the encapsulated toner alone for MICR documents.

EXAMPLE V

An 18.6 micron average diameter conductive black encapsulated toner comprising a poly(lauryl methacrylate) core resin and NP608 magnetite was prepared as in Example I.

The toner without encapsulation was prepared by melt blending in a DAVO extruder with heating at 160° C. followed by mechanical attrition, a toner composition comprised of 28 percent by weight of polyethylene wax of molecular weight of about 4,000 available from Petrolite, 7 percent of Elvax TM 420 available from Dupont, 7 percent of Versamide TM 744 from Henkel, and 58 percent of Mapico Black TM. The resultant toner had a volume average particle size of 22 microns after classification. The toner was dry blended with 0.5 percent of carbon black (Black Pearls TM 2000) and 1.75 percent of zinc stearate. Blending was continued until the volume resistivity of toner was from about $5\times10^4$ to about $5\times10^6$ ohm-cm.

Toner mixtures with amounts of 5 to 50 percent by weight of nonencapsulated toner, and 50 to 95 percent by weight of encapsulated toner were prepared by roll milling the encapsulated toner and toner without encapsulation together for one minute at 120 feet/minute. The above prepared toners were evaluated in a Xerox Corporation 4060 TM printer. The developed images were transfixed at 55° C. with a transfix pressure of 2,000 psi. The image fix of the encapsulated toner was 90 percent. The image fix of the toner without encapsulation was 28 percent. The image fix of the mixture of 70 percent of encapsulated and 30 percent of toner without encapsulation was 71 percent. Personal check documents with MICR characters were also printed in the same manner using these toners. The magnetic signal for the MICR "On-Us" character on these check documents was tested using the MICR-MATE I check reader, and provided values of 120 to 135 percent percent nominal. Images made from the toner mixture and worn by abrasion against paper at 2,500 checks/minute, showed a reduction of 40 times in the amount of toner offset to paper compared to the encapsulated toner alone, and a drop in the coefficient of friction of the toner image from 0.75 to 0.23. This is an illustration of the advantage of the inventive toner mixture over the encapsulated toner alone for MICR documents.

Other modifications of the present invention will occur to those skilled in the art subsequent to a review of the present application. These modifications, and equivalents thereof are intended to be included within the scope of this invention.

What is claimed is:

1. An ionographic process which comprises the generation of a latent image comprised of characters in a magnetic image character recognition apparatus; thereafter developing the image with a toner mixture consisting essentially of an encapsulated toner consisting essentially of a core of a lauryl methacrylate polymer and magnetite pigment, and thereover a polyurea polymeric shell and a toner free of encapsulation consisting essentially of styrene butylmethacrylate resin particles and magnetite pigment particles, which mixture contains from about 10 to about 50 percent by weight of said toner free of encapsulation and from about 90 to about 50 percent by weight of said encapsulated toner; and subsequently providing the developed fused image with magnetic ink characters thereon to a reader/sorter device, and wherein said fused images posses minimum toner offset or smearing characteristics to paper of 4.0 to about 0.5 milligram of toner at 2,500 checks per minute, and wherein said encapsulated toner contains on the surface thereof carbon black.

2. A process in accordance with claim 1 wherein the encapsulated toner composition contains magnetite particles in an amount of from about 20 to about 80 percent by weight.

3. A process in accordance with claim 1 wherein the toner free of encapsulation composition contains magnetite particles in an amount of from about 20 about 65 percent by weight.

* * * * *